US007983583B2

(12) United States Patent
Ota et al.

(10) Patent No.: US 7,983,583 B2
(45) Date of Patent: Jul. 19, 2011

(54) IMAGE FORMING APPARATUS, IMAGE FORMING METHOD, AND COMPUTER PROGRAM PRODUCT

(75) Inventors: Yuko Ota, Tokyo (JP); Yasuko Yamazaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 742 days.

(21) Appl. No.: 12/048,908

(22) Filed: Mar. 14, 2008

(65) Prior Publication Data

US 2008/0232835 A1 Sep. 25, 2008

(30) Foreign Application Priority Data

Mar. 19, 2007 (JP) ..... 2007-071585

(51) Int. Cl.
*G03G 15/00* (2006.01)

(52) U.S. Cl. ..... 399/81; 399/23; 399/45

(58) Field of Classification Search ..... 399/81, 399/45, 16, 23, 389
See application file for complete search history.

(56) References Cited

U.S. PATENT DOCUMENTS

| | | | | |
|---|---|---|---|---|
| 2003/0215252 | A1* | 11/2003 | Yokobori et al. | 399/45 |
| 2004/0141762 | A1* | 7/2004 | Okamoto et al. | 399/23 |
| 2005/0078983 | A1* | 4/2005 | Maruyama et al. | 399/227 |
| 2008/0094650 | A1* | 4/2008 | Suzuki | 358/1.12 |
| 2008/0175616 | A1* | 7/2008 | Nishida | 399/81 |

FOREIGN PATENT DOCUMENTS

| | | |
|---|---|---|
| JP | 2003-276288 | 9/2003 |
| JP | 2008-6754 | 1/2008 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

An image forming apparatus includes an image forming unit that forms an image on a sheet of recording medium, a sheet feed tray selecting unit, a medium size selecting unit that selects a first medium size, a medium type selecting unit that selects a medium type. A determining unit determines operation of the image forming unit based on a search result of a first sheet feed tray corresponding to the first medium size selected by the medium size selecting unit, a search result of a second sheet feed tray corresponding to the medium type selected by the medium type selecting unit, a selected tray selected by the sheet feed tray selecting unit, and resetting values specified for the operation of the image forming unit.

14 Claims, 12 Drawing Sheets

FIG. 4

406

PRIORITY TABLE FOR FEEDING TRAY

| PRIORITY | SHEET FEED TRAYS |
|---|---|
| 1 | SHEET FEED TRAY WITH HIGHEST PRIORITY (LEF, SEF) |
| 2 | TRAY 1 (LEF) |
| 3 | TRAY 2 (LEF) |
| 4 | TRAY 3 (LEF) |
| 5 | TRAY 4 (LEF) |
| 6 | MANUAL FEED TRAY (LEF) |
| 7 | TRAY 1 (SEF) |
| 8 | TRAY 2 (SEF) |
| 9 | TRAY 3 (SEF) |
| 10 | TRAY 4 (SEF) |
| 11 | MANUAL FEED TRAY (SEF) |

LEF: LONG EDGE FEED
SEF: SHORT EDGE FEED

FIG. 10

| CONDITIONS | SHEET SIZE | | SHEET TYPE | |
|---|---|---|---|---|
| | COMPARISON RESULTS | RESETTING VALUES | COMPARISON RESULTS | RESETTING VALUES |
| 1 | ○ | – | × | – |
| 2 | × | – | ○ | – |
| 3 | × | 1 | × | 1 |
| 4 | × | 3 TO 6 | × | 1 |
| 5 | × | 2 | × | – |
| 5 | × | – | × | 2 |
| 6 | × | 0 | × | 0 OR 1 |
| 6 | × | ANY ONE OF 0, 1, AND 3 TO 6 | × | 0 |

FIG. 11A

FIG. 11 | FIG. 11A | FIG. 11B

| SHEET FEED CONDITIONS | | | | PROCESSES | CORRE-SPONDENCE TO FIG. 10 |
|---|---|---|---|---|---|
| SPECIFIED TRAY | | SPECIFIED SHEET SIZE | SPECIFIED SHEET TYPE | | |
| NO DESIG-NATION | - | O | RESETTING VALUE 0 | OUTPUT | PROCESSING OF CONDITION (1) |
| | - | O | RESETTING VALUE 1 | OUTPUT | |
| | - | O | RESETTING VALUE 2 | OUTPUT | |
| | - | RESETTING VALUE 0 | O | OUTPUT | PROCESSING OF CONDITION (2) |
| | - | RESETTING VALUE 1 | O | OUTPUT | |
| | - | RESETTING VALUE 2 | O | OUTPUT | |
| | - | RESETTING VALUE 3-6 | O | RESIZE PAGE SIZE TO OUTPUT IMAGE | |
| | - | RESETTING VALUE 0 | RESETTING VALUE 0 | OUTPUT ERROR TO CANCEL JOB | PROCESSING OF CONDITION (6) |
| | - | RESETTING VALUE 0 | RESETTING VALUE 1 | OUTPUT ERROR TO CANCEL JOB | PROCESSING OF CONDITION (6) |
| | - | RESETTING VALUE 0 | RESETTING VALUE 2 | DISPLAY ON PANEL | PROCESSING OF CONDITION (5) |
| | - | RESETTING VALUE 1 | RESETTING VALUE 0 | OUTPUT ERROR TO CANCEL JOB | PROCESSING OF CONDITION (6) |
| | - | RESETTING VALUE 1 | RESETTING VALUE 1 | OUTPUT | PROCESSING OF CONDITION (3) |
| | - | RESETTING VALUE 1 | RESETTING VALUE 2 | DISPLAY ON PANEL | PROCESSING OF CONDITION (5) |
| | - | RESETTING VALUE 2 | RESETTING VALUE 0 | DISPLAY ON PANEL | PROCESSING OF CONDITION (5) |
| | - | RESETTING VALUE 2 | RESETTING VALUE 1 | DISPLAY ON PANEL | PROCESSING OF CONDITION (5) |
| | - | RESETTING VALUE 2 | RESETTING VALUE 2 | DISPLAY ON PANEL | PROCESSING OF CONDITION (5) |
| | - | RESETTING VALUE 3-6 | RESETTING VALUE 0 | OUTPUT ERROR TO CANCEL JOB | PROCESSING OF CONDITION (6) |

FIG. 11B

| | | | | | |
|---|---|---|---|---|---|
| | - | RESETTING VALUE 3-6 | RESETTING VALUE 1 | RESIZE PAGE SIZE TO OUTPUT IMAGE | PROCESSING OF CONDITION (4) |
| | - | RESETTING VALUE 3-6 | RESETTING VALUE 2 | DISPLAY ON PANEL | PROCESSING OF CONDITION (5) |
| DESIG-NATION | RESETTING VALUE 0 | O | - | OUTPUT ERROR TO CANCEL JOB | - |
| | RESETTING VALUE 1 | O | - | AUTOMATIC TRAY SELECTION | - |
| | RESETTING VALUE 2 | O | - | DISPLAY ON PANEL | - |
| | RESETTING VALUE 0 | - | O | OUTPUT ERROR TO CANCEL JOB | - |
| | RESETTING VALUE 1 | - | O | AUTOMATIC TRAY SELECTION | - |
| | RESETTING VALUE 2 | - | O | DISPLAY ON PANEL | - |
| | RESETTING VALUE 0 | - | - | OUTPUT ERROR TO CANCEL JOB | - |
| | RESETTING VALUE 1 | - | - | AUTOMATIC TRAY SELECTION | - |
| | RESETTING VALUE 2 | - | - | DISPLAY ON PANEL | - |

FIG. 12

| TRAY | SHEET SIZE | SHEET TYPE |
|---|---|---|
| TRAY 1 | × (RESETTING VALUE 0) | × (RESETTING VALUE 1) |
| TRAY 2 | × (RESETTING VALUE 0) | ○ |
| TRAY 3 | × (RESETTING VALUE 0) | × (RESETTING VALUE 1) |
| TRAY 4 | ○ | × (RESETTING VALUE 1) |

FIG. 13

| TRAY | SHEET SIZE | SHEET TYPE |
|---|---|---|
| TRAY 1 | × (RESETTING VALUE 2) | × (RESETTING VALUE 0) |
| TRAY 2 | × (RESETTING VALUE 2) | × (RESETTING VALUE 0) |
| TRAY 3 | × (RESETTING VALUE 2) | × (RESETTING VALUE 0) |
| TRAY 4 | × (RESETTING VALUE 2) | × (RESETTING VALUE 0) |

IMAGE FORMING APPARATUS, IMAGE FORMING METHOD, AND COMPUTER PROGRAM PRODUCT

CROSS-REFERENCE TO RELATED APPLICATIONS

The present application claims priority to and incorporates by reference the entire contents of Japanese priority document 2007-071585 filed in Japan on Mar. 19, 2007.

BACKGROUND OF THE INVENTION

1. Field of the Invention

The present invention relates to an image forming apparatus, an image forming method, and an image forming program.

2. Description of the Related Art

With recent advancements in network technology, network printers that are shared by many users have become prevalent. Because one network printer is typically shared by a lot of users, network printers are provided with a lot of sheet feed trays, to accommodate various types of papers, or papers of various sizes, to fulfill diversifying needs of the users.

However, the number of trays that can be mounted on a printer is limited. Therefore, a mismatch can occur on network printers. Mismatch here means differences between printing conditions specified by a user in a print instruction and the actual printer settings.

Japanese Patent Application Laid-Open No. 2003-276288 discloses a solution to this issue. Specifically, when a user selects a sheet size that is not available on a printer that the user is trying to use, a message that says that that sheet size is not available is displayed for the user. When the user sees such a message, he/she can decide whether to continue printing by selecting other sheet size or to cancel the printing. However, the acts of canceling printing and of determining whether there is a mismatch are time consuming and put a lot of burden on the user, the printer, and the network, and lead to lowering of the overall efficiency.

SUMMARY OF THE INVENTION

It is an object of the present invention to at least partially solve the problems in the conventional technology.

According to an aspect of the present invention, there is provided an image forming apparatus that includes an image forming unit capable of forming an image on a sheet of recording medium; a sheet feed tray selecting unit that selects a tray from among a plurality of sheet feed trays to feed a sheet of recording medium to the image forming unit; a medium size selecting unit that selects a first medium size of the sheet of recording medium from among a plurality of medium sizes; and a medium type selecting unit that selects a medium type of the sheet of recording medium from among a plurality of medium types, wherein the sheet feed tray selecting unit, the medium size selecting unit, and the medium type selecting unit include a function for specifying resetting values for an operation of the image forming unit; a determining unit that determines the operation of the image forming unit based on a search result of a first sheet feed tray corresponding to the first medium size selected by the medium size selecting unit, a search result of a second sheet feed tray corresponding to the medium type selected by the medium type selecting unit, the selected tray selected by the sheet feed tray selecting unit, and the resetting value.

According to another aspect of the present invention, there is provided an image forming method to be realized on an image forming apparatus, the image forming apparatus including an image forming unit capable of forming an image on a sheet of recording medium; a sheet feed tray selecting unit that selects a tray from among a plurality of sheet feed trays to feed a sheet of recording medium to the image forming unit; a medium size selecting unit that selects a first medium size of the sheet of recording medium from among a plurality of medium sizes; and a medium type selecting unit that selects a medium type of the sheet of recording medium from among a plurality of medium types, wherein the sheet feed tray selecting unit, the medium size selecting unit, and the medium type selecting unit include a function for specifying resetting values for an operation of the image forming unit. The image forming method including determining the operation of the image forming unit based on a search result of a first sheet feed tray corresponding to the first medium size selected by the medium size selecting unit, a search result of a second sheet feed tray corresponding to the medium type selected by the medium type selecting unit, the selected tray selected by the sheet feed tray selecting unit, and the resetting value.

According to still another aspect of the present invention, there is provided a computer program product that realizes the above image forming method on a computer.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is an example of the contents of a priority table for feeding tray shown in FIG. 3;

FIG. 10 is an example of contents of a condition table;

FIG. 11 is an example of a process table;

FIG. 12 is a table representing search results of the sheet feed tray of CASE 1 in the image output conditions of the image forming apparatus shown in FIG. 1; and FIG. 13 is a table representing search results of the sheet feed tray of CASE 2 in the image output conditions of the image forming apparatus shown in FIG. 1.

DETAILED DESCRIPTION OF THE PREFERRED EMBODIMENTS

Exemplary embodiments of an image forming apparatus, an image forming method, and a computer program product according to the present invention will be explained in detail below with reference to the accompanying drawings.

Figure 1:
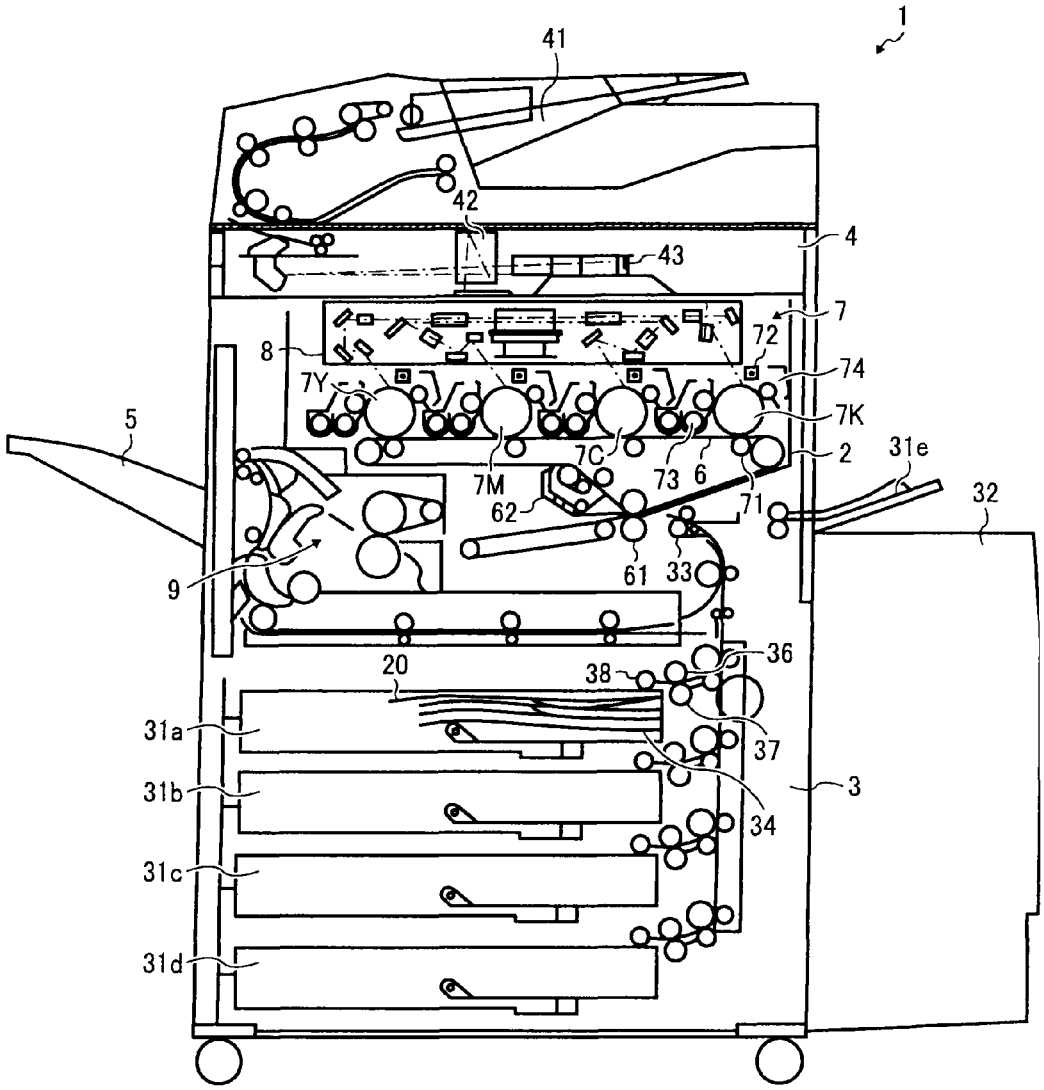
FIG. 1 is a schematic view of the internal structure of an image forming apparatus according to an embodiment of the present invention.

An image forming apparatus according to one embodiment of the present invention will now be explained. FIG. 1 is a schematic view of an image forming apparatus 1 according to the embodiment. The image forming apparatus 1 includes an image forming unit 2 in the center thereof. A sheet feed unit 3 is arranged below the image forming unit 2. The sheet feed unit 3 includes four sheet feed trays: 31*a*, 31*b*, 31*c*, 31*d*, and a manual feed tray 31*e*, each of which contains sheets of media (pieces of transfer paper) 20, and may include an additional sheet feeder 32, as required.

An image reading unit 4 that reads a document is arranged above the image forming unit 2. An ejected-sheet receiver 5 is protruded on the left side of the image forming unit 2 to discharge and put pieces of transfer paper on which an image is formed in place.

A plurality of imaging units 7 is arranged in line over an intermediate transfer belt 6 in the image forming unit 2. Each imaging unit 7 includes a drum-shaped photoconductor as part of imaging units 7Y, 7M, 7C, 7K. Around the photoconductor are provided a charger 72 that charges a surface of the photoconductor, an exposure device 8 that transmits image information to the surface thereof by laser beam, a developing device 73 that is exposed to visualize an electrostatic latent image formed thereon, and a cleaning device 74 that removes toner remaining thereon into the device.

The intermediate transfer belt 6 rotates to form a color image in the imaging process. In other words, at first, an imaging unit 7Y (yellow) at the leftmost develops a yellow (Y) toner to transfer a resultant yellow toner image to the intermediate transfer belt 6. Then, an imaging unit 7M (magenta)(M), an imaging unit 7C (cyan)(C), and an imaging unit 7K (black)(K) at the rightmost respectively develop a magenta (M), a cyan (C), and a black (K) toner to transfer each resultant toner color image to the intermediate transfer belt 6, respectively, in this order.

A transfer device 61 transfers on a sheet of paper a four-color toner image developed on the intermediate transfer belt 6. Moreover, an intermediate transfer cleaning device 62 removes toner remaining on the intermediate transfer belt 6 after the transfer.

A fixing device 9 that fixes the toner on the paper with the toner image is arranged below the image forming apparatus 1, which is downstream in the sheet feeding path. The paper passed through the fixing device 9 is ejected and received in the ejected-sheet receiver 5 by an ejecting roller.

Sheets of media 20 are stacked in the sheet feed trays 31*a*, 31*b*, 31*c*, 31*d*, and the manual feed tray 31*e*, each of which includes a base plate 34 rotatably supported therewith. One sheet is raised by the base plate 34 such that that sheet comes in contact with an uppermost pickup roller 38. In an example of the sheet feed tray 31*a*, rotation of sheet feed rollers 36 and 37 enables the uppermost sheet of medium 20 to be fed out of the sheet feed tray 31*a* to be conveyed upward to a resist roller 33.

The resist roller 33 is controlled to temporarily stop feeding the sheet of medium 20 to put the toner image on the photoconductor 71 and the top end of the sheet of medium 20 in place, and then start rotation of the resist roller 33 at this time.

A document placed on a contact glass is scanned, i.e. read, by the image reading unit 4. The scanned image information is read as an image signal to a charge-coupled device (CCD) sensor 43 via a lens 42. The read image signal is subjected to an image processing after digitization.

Then, an electrostatic latent image is formed on the photoconductor 71 by light emitted from a laser diode LD (not shown) in the exposure device 8 according to the image-processed signal. The light signal from the laser diode LD is transmitted to the photoconductor 71 through known polygon mirrors, lenses, or the like. The image reading unit 4 is provided with an automatic document feeder (ADF) 41 over the unit 4, which automatically feeds a document to the contact glass.

The image forming apparatus 1 can be a facsimile that exchanges image information of a document between a controller (not shown) and a remote location, a printer that prints image data on a sheet of paper sent from a computer, or a digital color copier that reads out an image by scanning a document to digitalize and copy the document on the paper.

Figure 2:
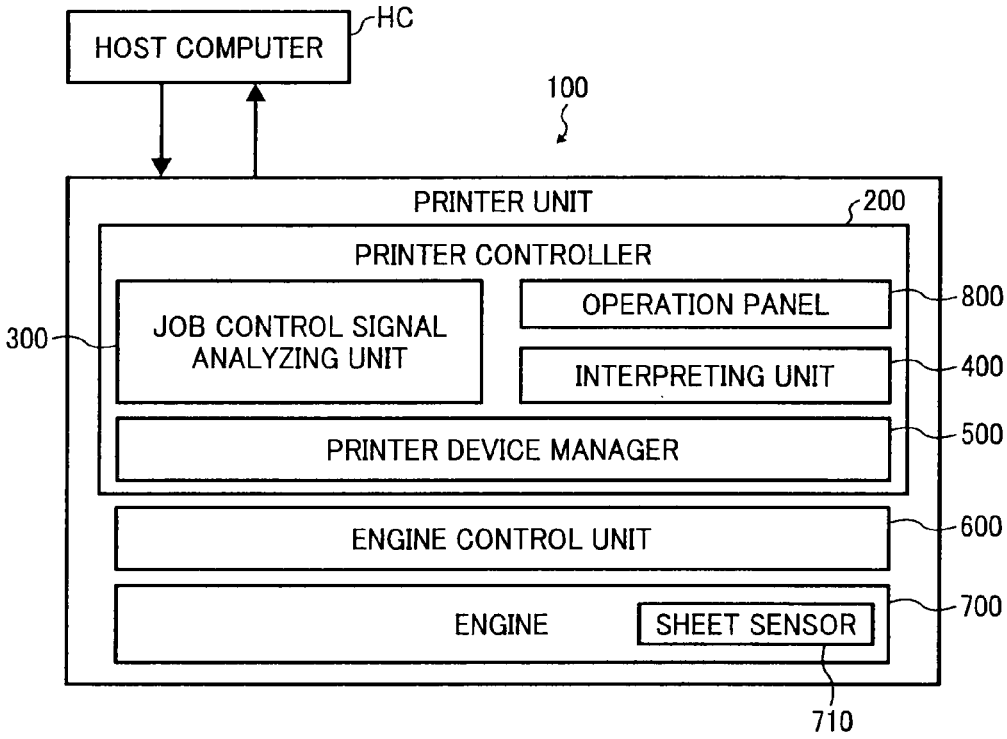
FIG. 2 is a block diagram of a printer unit of the image forming apparatus shown in FIG. 1.

The image forming apparatus 1 includes a printer unit. FIG. 2 is a block diagram of a printer unit 100. The printer unit 100 functions to output on the sheet of medium 20 an image of print data sent from a host computer HC, and includes a printer controller 200, an engine control unit 600, and an engine 700.

The engine 700 is a marking engine that outputs an image on the sheet of medium 20, and includes the image forming unit 2, the sheet feed unit 3, and a sheet sensor 710 in the sheet feed trays 31*a* to 31*e*, as shown in FIG. 1. The sheet sensor 710 functions to sense a sheet of paper, specifically sheet sizes and sheet types, placed on the sheet feed trays 31*a* to 31*e*. Alternatively, it is possible to have a configuration in which a user presses a button to specify a sheet size and a sheet type.

The engine control unit 600 functions to receive an image signal and a control signal from the printer controller 200 to actually control the operation of the engine 700.

The printer controller 200 functions to interpret the received print data, and internally includes a job control signal analyzing unit 300, an interpreting unit 400, a printer device manager 500, and an operation panel 800.

The job control signal analyzing unit 300 functions to receive print data, prioritize jobs, both sent from the host computer HC, as well as to instruct the engine 700 to control output of an image, and then send the print data to the interpreting unit 400.

The interpreting unit 400 functions to interpret image data and image output conditions described in the print data to convert them into an image signal and a control signal to make the engine 700 appropriately output an image. The print data will be explained in detail below.

The printer device manager 500 functions to generate a signal to control the operation of the engine 700 corresponding to a signal specifying the image output conditions sent based on the information in the print data interpreted by the interpreting unit 400 to transmit the signal to the engine control unit 600.

The operation panel 800 functions to display feeding information (on a sheet feed tray, a sheet size, and a sheet type) specified by a user. When the feeding information does not correspond to sheet information sensed by the respective sheet feed trays, the operation panel 800 prompts the user to change the conditions.

Figure 3:
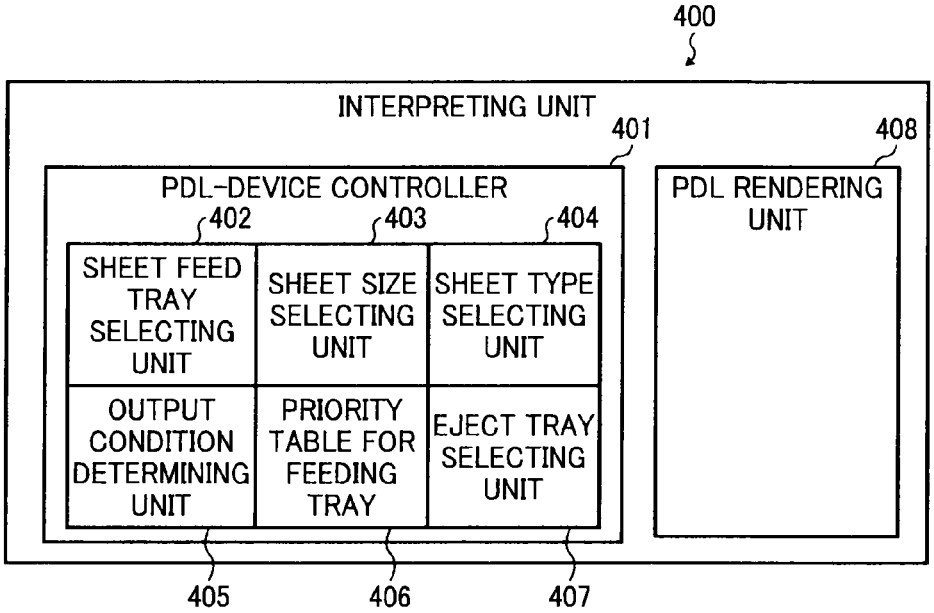
FIG. 3 is a block diagram of an interpreting unit shown in FIG. 3.

A configuration of the interpreting unit 400 will be explained in detail below. FIG. 3 is a block diagram of the interpreting unit 400. The interpreting unit 400 functions to interpret the image data and the image output conditions described in the print data to convert them into an image signal and a control signal to make the engine 700 appropriately output an image, and includes a PDL-device controller 401 and a PDL rendering unit 408.

The PDL rendering unit 408 functions to interpret a drawing command described in the image data included in the print data to convert the command into an image format in which the engine 700 can output an image. That is, the PDL rendering unit 408 interprets the image data described in a printer description language to convert the image data into a bitmapped image of which the engine 700 can output an image. With a color printer, the PDL rendering unit 408 generally converts image data into a CMYK (four) channel bitmapped image. The bitmapped image data is transferred to respective image memories for CMYK channels (not shown) in the engine control unit 600, and then is transmitted from the image memories to the engine 700 to output the image.

A PDL-device controller 401 functions to control the operation of the engine 700 on the image output, and includes a sheet feed tray selecting unit 402, a sheet size selecting unit 403, a sheet type selecting unit 404, an output condition determining unit 405, a priority table for feeding tray 406, and an eject tray selecting unit 407.

The sheet feed tray selecting unit 402 functions to receive sheet feed tray selecting information specified by the user to transmit the designation signal for the sheet feed tray to the printer device manager 500 on image output based on the sheet feed tray selecting information. The sheet feed tray selecting information will be explained in detail below.

The sheet size selecting unit 403 functions to receive sheet size selecting information specified by the user to transmit the designation signal for the sheet size to the printer device manager 500 on image output based on the sheet size selecting information. The sheet size selecting information will be explained in detail below.

The sheet type selecting unit 404 functions to receive sheet type selecting information specified by the user to transmit the designation signal for the sheet type to the printer device manager 500 on image output based on the sheet type selecting information. The sheet type selecting information will be explained in detail below.

The output condition determining unit 405 functions to determine image output conditions of the image forming apparatus 1. The output condition determining unit 405 determines image output conditions based on sheet feed tray selecting information, sheet size selecting information, sheet type selecting information, resetting values specified on selection of each information, information on sheet sizes and types of each sheet feed tray sensed by the sheet sensor 710 in the engine 700. The output condition determining unit 405 transmits the designation signal for determined image output conditions to the printer device manager 500.

The eject tray selecting unit 407 functions to receive eject tray selecting information specified by the user to transmit the designation signal for the eject tray to the printer device manager 500 on image output based on the eject tray selecting information.

The priority table for feeding tray 406 is a table stored in the PDL-device controller 401 and is referred to when there are many options for sheet feed trays on image output. FIG. 4 is an example of the contents of the priority table for feeding tray 406. Also, FIG. 4 is the table structure representing a priority selection criterion of feeding trays, specifically representing the user-specified sheet feed tray and the other trays prioritized in order of shortness of time of conveying a sheet from each sheet feed tray to the image forming unit 2.

The priority table for feeding tray 406 is a table of priorities and the sheet feed trays corresponding to each other. As for the table as shown in FIG. 4, the user-specified sheet feed tray is given the highest priority, and the other trays 31*a* to 31*e* are respectively prioritized in order of shortness of time of conveying a sheet. Long edge feed (LEF) is prioritized over short edge feed (SEF) in FIG. 4.

Priorities of sheet feed trays with the printer unit 100 are described in the priority table for feeding tray 406. In the example shown in FIG. 4, the user-specified sheet feed tray is set to be the highest priority, and the other trays 31*a* to 31*e* are given respective priorities in this order according to the time of conveying a sheet from each sheet feed tray to the image forming unit 2.

The priority table for feeding tray 406 can be set up when products are shipped from a factory. Alternatively, a user can set the priority table for feeding tray 406 by using an operation panel or the like after the shipment of the product.

As explained above, the priority table for feeding tray 406 is one in which priorities for each sheet feed tray are determined by the user designation and the order of shortness of time of conveying a sheet. The sheet feed trays referred to by the printer unit 100 are given priorities among the user-specified sheet feed tray and the other sheet feed trays with the printer unit 100, as shown in FIG. 4.

The designation signals internally generated by the respective units of the PDL-device controller 401 are transmitted to the printer device manager 500 to make the engine control unit 600 generate a control signal to control the operation of the engine 700, as explained earlier.

Figure 5:
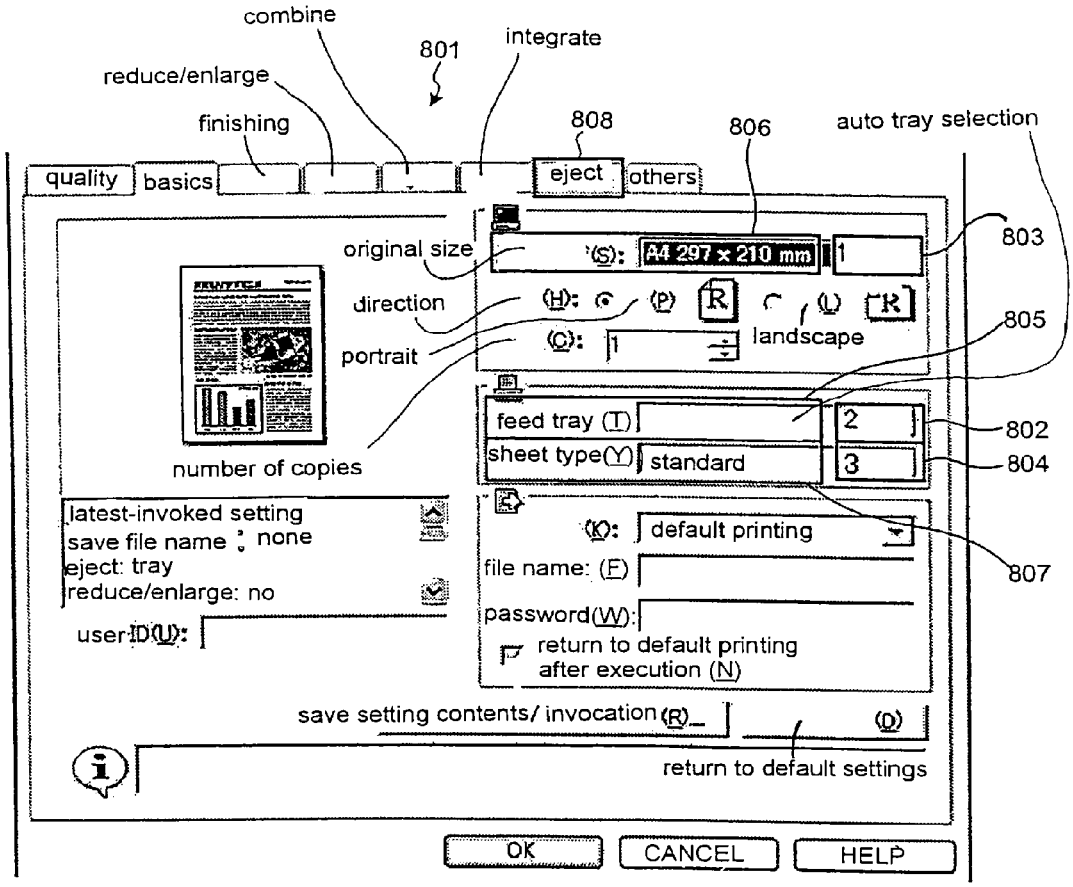
FIG. 5 is an example of a printer setup screen.

A printer setup screen to select a sheet feed tray, a sheet size, and a sheet type will be explained in detail below. FIG. 5 is an example of a printer setup screen 801. The printer setup screen 801 functions to specify seven image output conditions as a basic setup menu, and includes a sheet feed tray resetting value box 802, a sheet size resetting value box 803, a sheet type resetting value box 804, a sheet feed tray selecting box 805, a sheet size selecting box 806, a sheet type selecting box 807, and an eject tray selecting box 808.

The sheet feed tray selecting box 805 is a box to select a sheet feed tray to output an image. Specifically, the sheet feed tray selecting box 805 is a box to select one of sheet feed trays 31*a* to 31*e* shown in FIG. 1.

The sheet size selecting box 806 is a box to select a sheet size to output an image. Specifically, the sheet size selecting box 806 is a box to select one of standard paper sizes such as A4, A3, B5, B4, Letter, and Legal.

The sheet type selecting box 807 is a box to select a sheet type to output an image. Specifically, the sheet type selecting box 807 is a box to select one of types of paper quality such as recycled paper, high-quality paper, and coated paper.

The eject tray selecting box 808 is a box to specify a tray to eject a sheet of paper after outputting an image. Specifically, the eject tray selecting box 808 is a box to specify the ejected-sheet receiver 5 shown in FIG. 1, or other devices when post-processing devices such as a stapler (not shown) and a paper folder (not shown) are connected to the apparatus.

The sheet feed tray resetting value box 802 is a box to select a sheet feed tray resetting value to specify an operation when the image output condition of the sheet feed tray selected at the sheet feed tray selecting box 805 does not correspond to the other selection conditions. Specifically, the sheet feed tray resetting value box 802 is the box to select one of values; "0" to output an error to cancel a job, "1" to ignore the user designation to continue processing, and "2" to display selection conditions on the operation panel.

The sheet size resetting value box 803 is a box to select a sheet size resetting value to specify an operation when the image output condition of the sheet size selected at the sheet size selecting box 806 does not correspond to the other selection conditions. Specifically, the sheet size resetting value box 803 is the box to select one of values "0", "1", "2", "3", "4", "5", and "6". The image forming apparatus 1 has boxes for values "0" to "6" to select one of them, and each of which means as follows: "0" to output an error to cancel a job, "1" to ignore the user designation to continue processing, "2" to display selection conditions on the operation panel, "3" to select "a sheet size of a scale factor closest to a full scale" and "a scale factor closest to a full scale", "4" to select "a minimum sheet size covering the selected sheet size" and "a scale factor of a minimum size covering the selected sheet size", "5" to select "a sheet size of a scale factor closest to a full scale" and "a full scale", and "6" to select "a minimum sheet size covering the selected sheet size" and "a full scale".

The sheet type resetting value box 804 is a box to select a sheet type resetting value to specify an operation when the image output condition of the sheet type selected at the sheet type selecting box 807 does not correspond to the other selection conditions. Specifically, the sheet type resetting value box 804 is the box to select one of values; "0" to output an error to cancel a job, "1" to ignore the user designation to continue processing, and "2" to display the selection conditions on the operation panel.

At the time of selecting the seven image output conditions and transmitting a print command on the printer setup screen 801 by the user, information on the seven image output conditions included in the print data is attached to the image data to transmit the data as print data from the host computer HC to the printer unit 100. Although the sheet feed tray resetting value box 802, the sheet size resetting value box 803, and the sheet type resetting value box 804 are shown in FIG. 5, those parameters can be provided in other ways. For example, those parameters can be input via the operation panel, or can be automatically determined.

Figure 6:
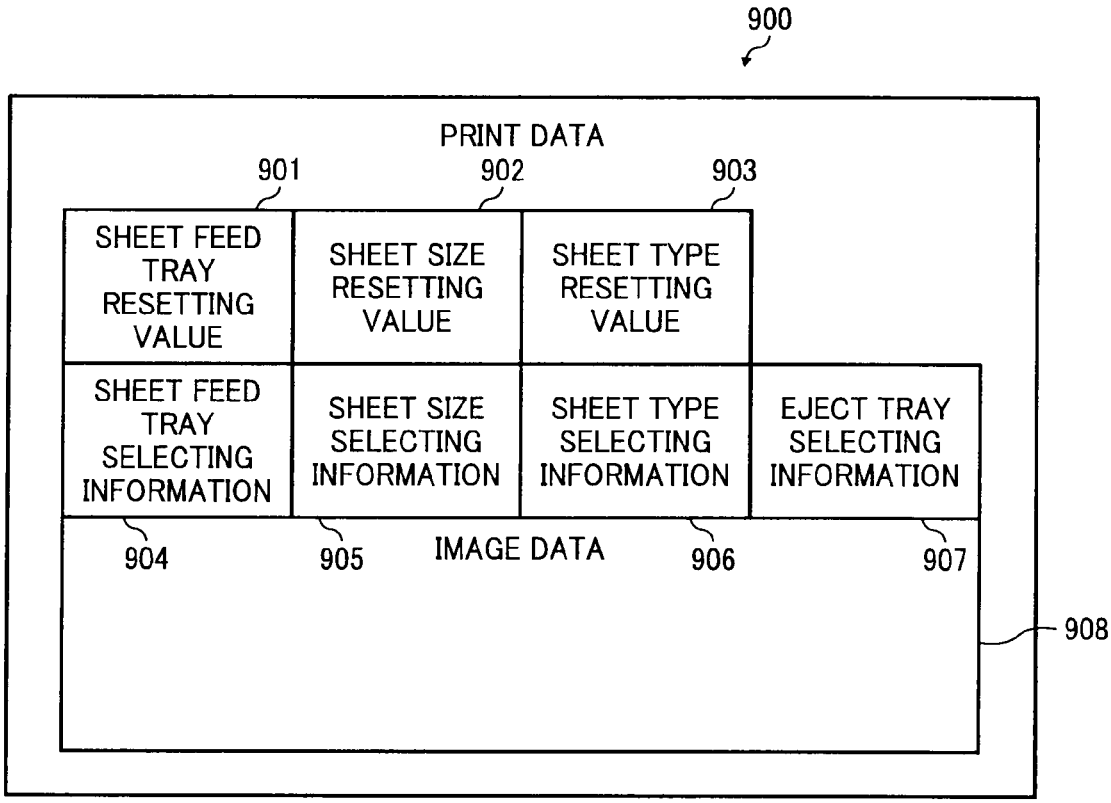
FIG. 6 is an example of contents of print data.

An example of a print data structure will be explained below. FIG. 6 is an example of the contents of print data 900. The user picks up an output image from the host computer HC, selects the desired image output conditions on the printer setup screen 801, and transmits the print data 900 to the printer unit 100.

The print data 900 includes a sheet feed tray resetting value 901, a sheet size resetting value 902, a sheet type resetting value 903, sheet feed tray selecting information 904, sheet size selecting information 905, sheet type selecting information 906, and eject tray selecting information 907 according to user designation, in addition to image data 908.

Designation of the sheet feed tray selecting information 904 includes designation of the sheet feed tray resetting value 901, designation of the sheet size selecting information 905 involves designation of the sheet size resetting value 902, and designation of the sheet type selecting information 906 involves designation of the sheet type resetting value 903.

The sheet feed tray selecting information 904 contains information on the sheet feed tray specified at the sheet feed tray selecting box 805 when the user gives instructions to print, which describes information on the user selection of a sheet feed tray among 31*a* to 31*e*. When the interpreting unit 400 receives the print data 900, the sheet feed tray selecting information 904 selects a sheet feed tray at the sheet feed tray selecting unit 402 to transmit the information to the output condition determining unit 405 for determination of the image output condition.

The sheet feed tray resetting value 901 describes information on the sheet feed tray resetting value specified at the sheet feed tray resetting value box 802, when the user gives instructions to print. The sheet feed tray resetting value 901 specifies an operation when the condition of the sheet feed tray described in the sheet feed tray selecting information 904 does not correspond to the other selection conditions such as a sheet size and a sheet type. When the interpreting unit 400 receives the print data 900, the sheet feed tray resetting value 901 is transmitted to the output condition determining unit 405 for determination of the image output condition.

The sheet size selecting information 905 describes information on the specified sheet size at the sheet size selecting box 806. When the interpreting unit 400 receives the print data 900, the sheet size selecting unit 403 selects a sheet size based on the sheet size selecting information 905 and transmits the information to the output condition determining unit 405 for determination of the image output condition.

The sheet size resetting value 902 describes information on the sheet size resetting value specified at the sheet size resetting value box 803. The sheet size resetting value 902 specifies an operation when the condition of the sheet size described in the sheet size selecting information 905 does not correspond to the other selection conditions such as a sheet feed tray and a sheet type. When the interpreting unit 400 receives the print data 900, the sheet size resetting value 902 is transmitted to the output condition determining unit 405 for determination of the image output condition.

The sheet type selecting information 906 describes information on the specified sheet type at the sheet type selecting box 807. When the interpreting unit 400 receives the print data 900, the sheet type selecting information 906 selects a sheet type at the sheet type selecting unit 404 to transmit the information to the output condition determining unit 405 for determination of the image output condition.

The sheet type resetting value 903 describes information on the sheet type resetting value specified at the sheet type resetting value box 804. The sheet type resetting value 903 specifies an operation when the condition of the sheet type described in the sheet type selecting information 906 does not correspond to the other selection conditions such as a sheet feed tray and a sheet size. When the interpreting unit 400 receives the print data 900, the sheet type resetting value 903 is transmitted to the output condition determining unit 405 for determination of the image output condition.

The eject tray selecting information 907 describes information on a tray to eject a sheet of paper after image formation specified at the eject tray selecting box 808. When the interpreting unit 400 receives the print data 900, the eject tray selecting information 907 selects an eject tray at the eject tray selecting unit 407 to transmit the selection signal to the printer device manager 500.

Figure 7:
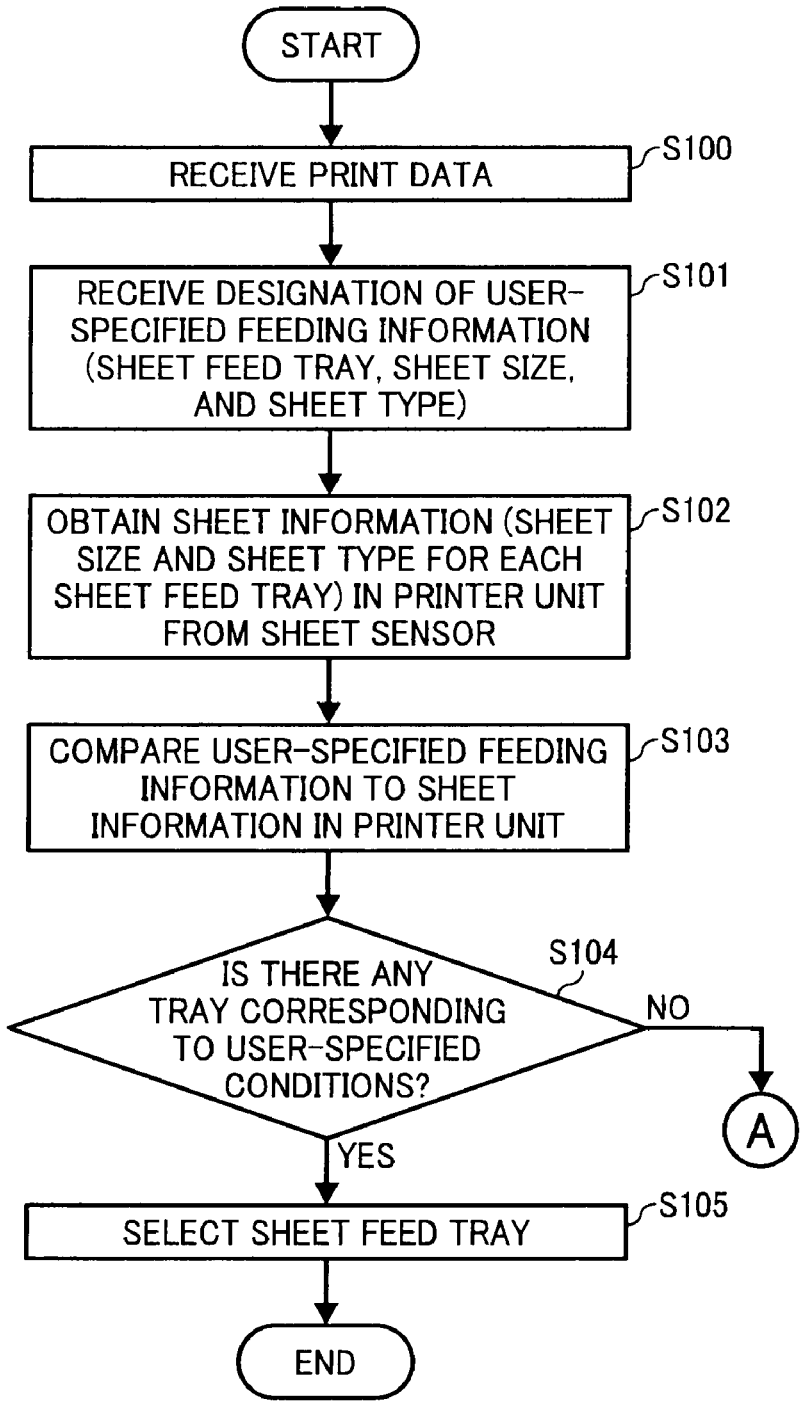
FIGS. 7 to 9 are flowcharts of an image output condition determining process performed by the image forming apparatus shown in FIG. 1.
Figure 8:
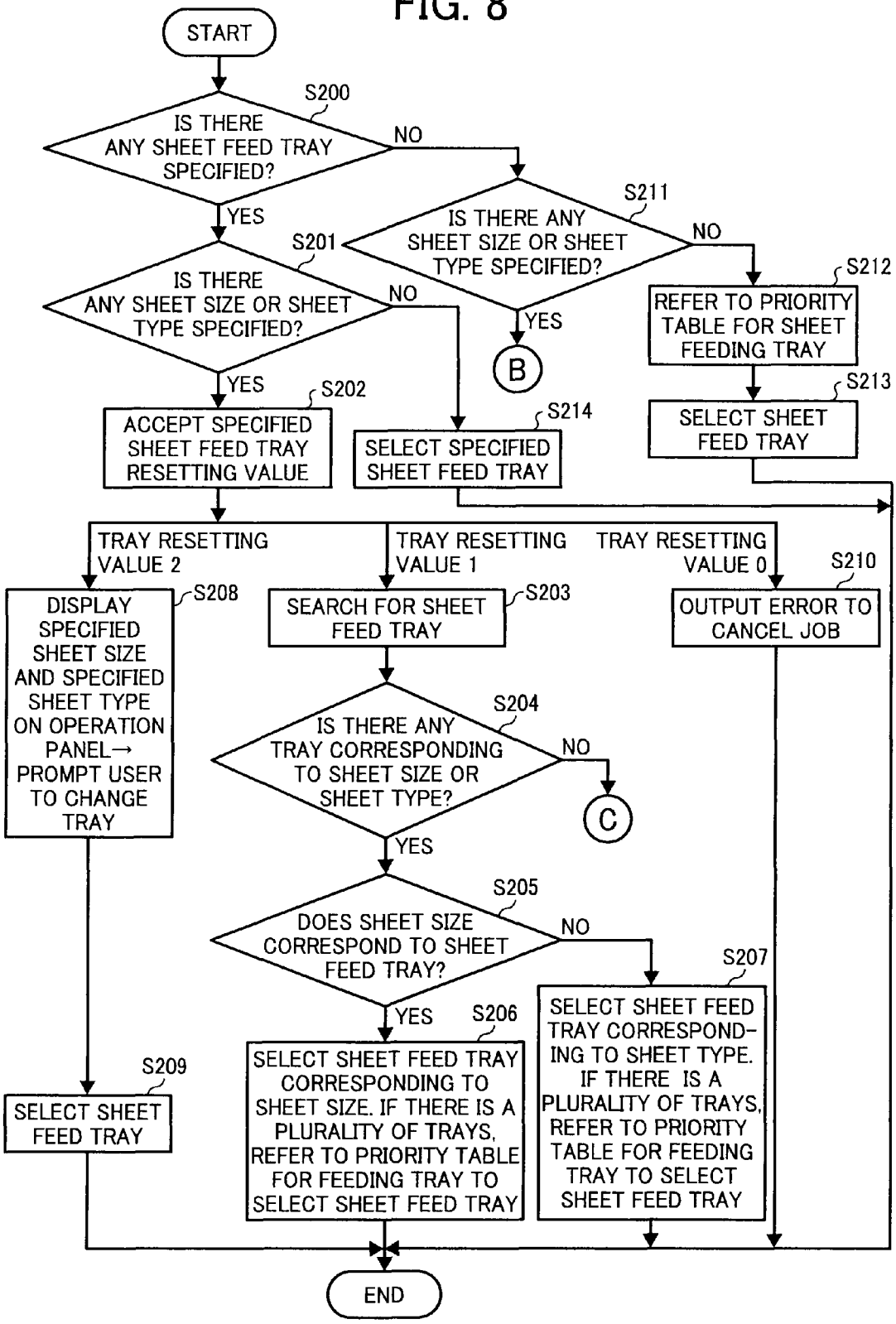
Figure 9:
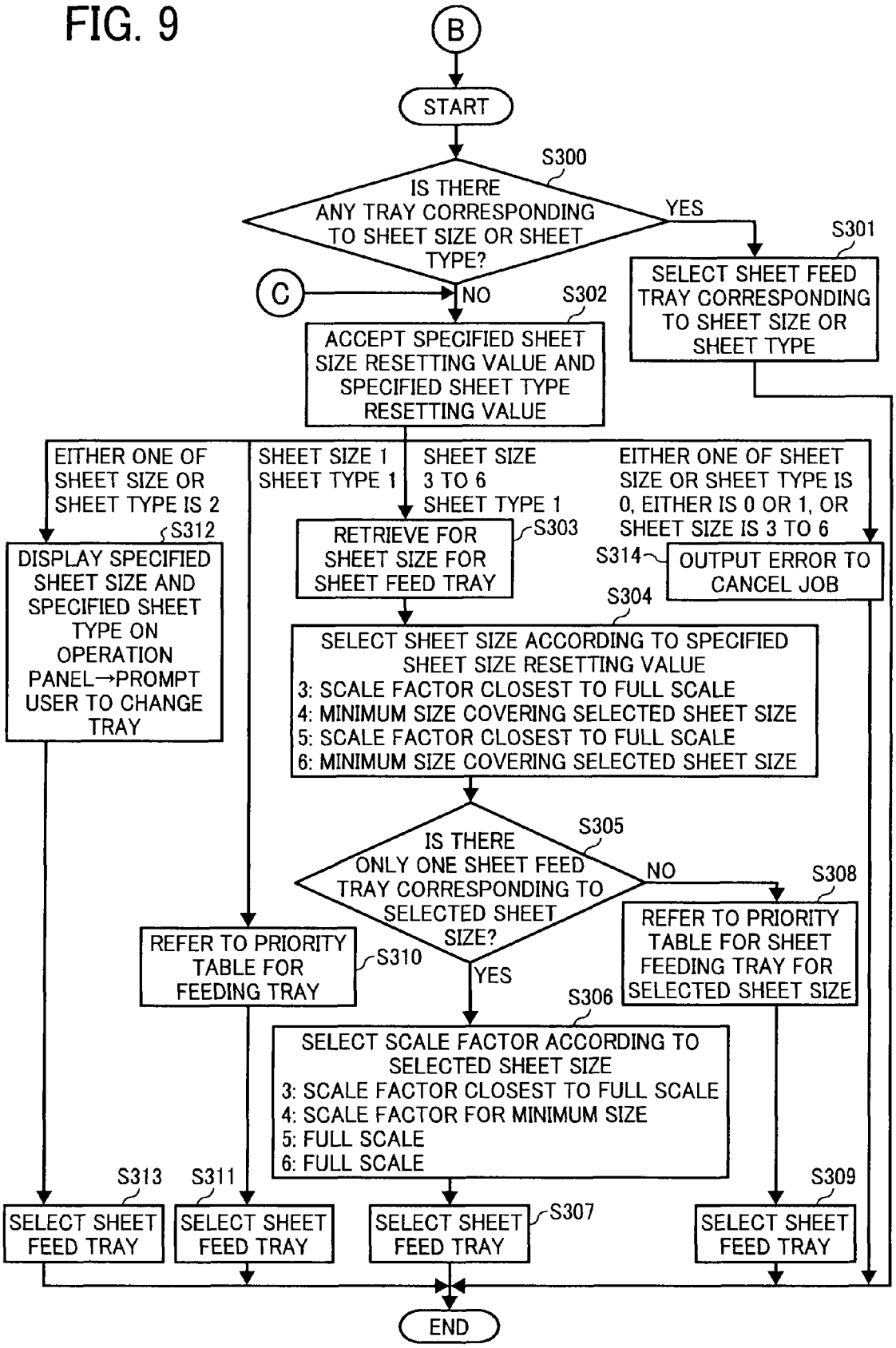

The procedures to determine the image output conditions by the output condition determining unit 405 when the printer unit 100 receives the print data 900 will be explained in detail below. FIGS. 7 to 9 are flowcharts of an image output conditions determining process performed by the image forming apparatus 1.

First, the interpreting unit 400 receives the print data 900 (step S100). Then, the output condition determining unit 405 receives user-specified feeding information (a sheet feed tray, a sheet size, and a sheet type) (step S101) to obtain the sheet information (sheet sizes and sheet types for the respective sheet feed trays) in the printer unit 100 from the sheet sensor 710 (step S102).

The output condition determining unit 405 compares the user-specified feeding information with the sheet information in the printer unit 100 (step S103) to determine if there is any sheet feed tray corresponding to the user-specified conditions (step S104). If any (YES at step S104), the output condition determining unit 405 selects the relevant tray to instructs the printer device manager 500 to output the image (step S105). If not (NO at step S104), the system control goes to Part (A) in the flowchart shown in FIG. 8.

In Part (A), first, the output condition determining unit 405 determines if there is any specified sheet feed tray (step S200). If any (YES at step S200), the output condition determining unit 405 determines if there is any specified sheet size or type (step S201). If any (YES at step S201), the output condition determining unit 405 accepts the specified sheet feed tray resetting value 901 (step S202).

If the sheet feed tray is not specified at step S200 (NO at step S200), the output condition determining unit 405 determines if there is any specified sheet size or type (step S211). If not (NO at step S211), the output condition determining unit 405 refers to the priority table for feeding tray 406 (step S212). The output condition determining unit 405 then selects a sheet feed tray based on reference to the priority table for feeding tray 406 to instruct the printer device manager 500 to output the image (step S213). If a sheet size or type is specified (YES at step S211), the process goes to Part (B) in the flowchart shown in FIG. 9.

On the other hand, at step S201, if no sheet size or sheet type is specified (No at step S201), the output condition determining unit 405 selects the specified sheet feed tray to instruct the printer device manager 500 to output the image (step S214).

At step S202, when "1" is specified for the sheet feed tray resetting value 901, the output condition determining unit 405 retrieves the relevant sheet feed tray (step S203). Then, the output condition determining unit 405 determines if there is any sheet feed tray corresponding to either sheet size or sheet type (step S204). If either corresponds to the sheet feed tray (YES at step S204), the output condition determining unit 405 determines if a sheet size corresponds thereto (step S205). If a sheet size does (YES at step S205), the output condition determining unit 405 selects the sheet feed tray corresponding to the sheet size. When a plurality of sheet feed trays are met for the sheet size, the output condition determining unit 405 refers to the priority table for feeding tray 406 to finally determine the relevant sheet feed tray to instructs the printer device manager 500 to output the image (step S206).

At step S204, if there is no sheet feed tray corresponding to a sheet size or a sheet type (NO at step S204), the process goes to Part (C) in the flowchart shown in FIG. 9.

If no sheet size corresponds to the sheet feed tray (NO at step S205), the output condition determining unit 405 determines that a sheet type corresponds to the sheet feed tray, thereby selecting the sheet feed tray corresponding to the sheet type. When a plurality of sheet feed trays are met for the sheet type, the output condition determining unit 405 refers to the priority table for feeding tray 406 to finally determine the relevant sheet feed tray to instruct the printer device manager 500 to output the image (step S207).

At step S202, when "2" is specified for the sheet feed tray resetting value, the output condition determining unit 405 displays the user-specified sheet size and type on the operation panel 800 to prompts the user to change the conditions of the specified sheet (step S208). Then, the output condition determining unit 405 selects the sheet feed tray to instruct the printer device manager 500 to output the image (step S209).

At step S202, when "0" is specified for the sheet feed tray resetting value, the output condition determining unit 405 outputs an error to instruct the printer device manager 500 to cancel the job (step S210).

As shown in FIG. 9, first, the output condition determining unit 405 determines if there is any specified sheet feed tray corresponding to a sheet size or a sheet type (step S300). If any (YES at step S300), the output condition determining unit 405 selects the sheet feed tray to instruct the printer device manager 500 to output the image (step S301). If there is no sheet feed tray corresponding to a sheet size or a sheet type (NO at step S300), the output condition determining unit 405 accepts the specified sheet size resetting value 902 and the specified sheet type resetting value 903 (step S302).

At step S302, when the sheet size resetting value 902 is any one of "3", "4", "5", and "6" and the sheet type resetting value 903 is "1", the output condition determining unit 405 retrieves a sheet size for the sheet feed tray (step S303) to select the sheet size according to a specified value of the sheet size resetting value 902 (step S304). Then, the output condition determining unit 405 determines if only one sheet feed tray corresponds to the selected sheet size (step S305). If there is only one (YES at step S305), the output condition determining unit 405 selects the scale factor of the image according to the sheet size resetting value 902 specified by the user (step S306). The output condition determining unit 405 selects the sheet feed tray based on the selected sheet size and the scale factor thereof, thereby instructing the printer device manager 500 to output the image (step S307).

If a plurality of the sheet feed trays correspond to the selected sheet size at step S305 (NO at step S305), the output condition determining unit 405 refers to the priority table for feeding tray 406 for the selected sheet size (step S308). Then, the output condition determining unit 405 selects a sheet feed tray based on reference to the priority table for feeding tray 406 to instruct the printer device manager 500 to output the image (step S309).

At step S302, when "1" is specified for either one of the sheet size resetting value 902 or the sheet type resetting value 903, the output condition determining unit 405 refers to the priority table for feeding table 406 (step S310). Then, the output condition determining unit 405 selects the sheet feed tray based on reference to the priority table for feeding tray 406 to instruct the printer device manager 500 to output the image (step S311).

When "2" is specified for either one of the sheet size resetting value or the sheet type resetting value at the step S302, the output condition determining unit 405 displays the user-specified sheet size and type on the operation panel 800 to prompts the user to change the image output conditions of the sheet (step S312). Accordingly, the output condition determining unit 405 selects a sheet feed tray to instruct the printer device manager 500 to output the image (step S313).

When either one of the sheet size resetting value or the sheet type resetting value is "0", either is "0" or "1", or the sheet size resetting value is one of "3" to "6" at step S302, the output condition determining unit 405 outputs an error to instruct the printer device manager 500 to cancel the job (step S314).

A final operation for the image forming unit 2 is determined according to the user-specified feeding information, sheet information on the sheet feed tray, and the user-specified resetting values. FIGS. 10 and 11 are condition tables of processes based on the specified resetting values explained in the flowcharts in FIGS. 7, 8, and 9. FIG. 10 is a condition table specifying resetting values of a sheet size and a sheet type of the image forming apparatus according to the embodiment.

FIG. 11 is a process table specifying resetting values of a sheet feed tray, a sheet size, and a sheet type of the image forming apparatus according to the embodiment. FIG. 11 corresponds to the conditions 1 to 6 in FIG. 10 as stated in "CORRESPONDENCE TO FIG. 10" in the rightmost column of FIG. 11.

In FIGS. 10 and 11, "O" denotes the match between the sheet information on the sheet feed tray and the user-specified feeding information, while "X" denotes the mismatch between the sheet information on the sheet feed tray and the user-specified feeding information. The numbers denote user-specified resetting values, and "-" denotes no dependence on the resetting values.

The method of determining the image output conditions according to the embodiment has been explained in detail. Here, two cases for the actual procedures in response to the user-specified conditions will be explained below. For simple explanation, let us assume that the sheet feed tray with the highest priority is TRAY 1 with reference to the priority table for feeding tray 406 and the state of sheet feed trays with the printer unit 100 is as follows.

<State of Sheet Feed Trays with Printer Unit>
TRAY 1: LETTER, PLAIN PAPER
TRAY 2: LETTER, SPECIAL PAPER
TRAY 3: LETTER, PLAIN PAPER
TRAY 4: A4, PLAIN PAPER
CASE 1
<User-Specified Conditions>
SHEET SIZE: A4
SHEET SIZE RESETTING VALUE: 0
SHEET TYPE: SPECIAL PAPER
SHEET TYPE RESETTING VALUE: 1

In this case, the sheet type of TRAY 2 and the sheet size of TRAY 4 match the user-specified conditions; therefore the search result of the sheet feed tray in FIG. 12 denotes that TRAY 2 is "0", and the others are "X". FIG. 12 is a table representing search results of the sheet feed tray from CASE 1 in the image output conditions of the image forming apparatus according to the embodiment. The sheet size is given higher priority than the sheet type, accordingly the sheet feed tray matched with the sheet size is prioritized to select TRAY 4 to output the image.

CASE 2
<User-Specified Conditions>
SHEET SIZE: A3
SHEET SIZE RESETTING VALUE: 2
SHEET TYPE: RECYCLED PAPER
SHEET TYPE RESETTING VALUE: 0

In this case, no trays matches the user-specified sheet feed tray, resulting in the search result of the sheet feed tray with all "X" as shown in FIG. 13. FIG. 13 is a table representing search results of the sheet feed tray from CASE 2 of the image output conditions of the image forming apparatus according to the embodiment. As seen from the table, the search results depend on the specified-resetting values. In the table, the sheet size resetting value is specified as "2"; therefore, the selected sheet is displayed on the operation panel 800 to prompt the user to change the conditions.

According to the embodiment, when the user gives instructions to output the image, the user can specify the resetting values of the respective conditions in addition to the sheet feed tray, the sheet size, and the sheet type, and thus, the image output conditions can be determined in consideration of the conditions defined by the resetting values, as explained above. This process can reduce cancelation of printing jobs or lengthening of time even when the user-specified conditions do not correspond to the setup conditions of the image forming apparatus at the time of outputting the image, resulting in image forming functions with higher efficiency in operation.

In this embodiment, the operation is explained with the assumption that the sheet feed tray, the sheet size, and the sheet type are specified when the user instructs the printer unit 100 to output the image. However, the interpreting unit 400 may sense information on a document size such as A4, A3, and B4 described in an electronic document to input the information to the output condition determining unit 405 according to the embodiment. That is, the information on the document size such as A4, A3, and B4 described in the electronic document may be utilized for determination, instead of the sheet size selecting information 905 according to the embodiment.

It is explained above that the user selects the sheet feed tray, the sheet size, and the sheet type when the user instructs the printer unit 100 to output the image in this embodiment. Alternatively, optical sensors and the like in a copier may automatically sense a document size to perform the process of the output condition determining unit 405 according to the embodiment based on the document size. That is, the information on the document size may be supplanted by the sheet size selecting information 905 according to the embodiment to be utilized for determination.

It is also explained that the sheet sensors mounted on the respective sheet feed trays sense the sheet sizes and the sheet types on sensing them in this embodiment. The user may specify some conditions from options.

Detail of changing the image forming conditions such as transfer and fixation depending on the sheet types is not described in the present embodiment. However, a value of transfer current and a fixation setting temperature on image formation can be changed at the time of sensing or user specifying a sheet type such as high-quality paper and coated paper, for example. As such, changing the image forming conditions depending on the sheet type allows the user to obtain an appropriate sample from image output corresponding to more specific sheet types.

The image forming program to be executed in the image forming apparatus according to the embodiment is previously stored in ROM or the like to be provided.

The image forming program may be configured to be stored on a computer readable recording medium such as a CD-ROM, a flexible disk (FD), CD-R, digital versatile disk (DVD) in an installable format file or an executable format file to be provided.

The image forming program may be configured to be stored on a computer connected to a network such as the Internet to allow the user to download via the network. Also, the image forming program to be executed by the image forming apparatus according to the embodiment may be configured to be provided or distributed via a network such as the Internet.

The image forming program is a module configuration including the units explained above (the sheet feed tray selecting unit, the sheet size selecting unit, the sheet type selecting unit, and the output condition determining unit). As for an actual hardware, a CPU (processor) reads out the image forming program from the ROM to load the data of the units on a main memory whereby producing on the main memory the sheet feed tray selecting unit, the sheet size selecting unit, the sheet type selecting unit, and the output condition determining unit.

The invention is not limited to the embodiment as explained above. In implementation, components thereof may be modified within the scope of the gist thereof to embody the embodiment. Also, a plurality of components disclosed in "DETAILED DESCRIPTION OF THE PREFERRED EMBODIMENTS" may be appropriately combined with each other to embody the present invention in various forms. For example, certain components illustrated in the embodiment can be removed. Furthermore, components in different embodiments may be appropriately combined with each other.

According to an aspect of the present invention, when outputting an image to the image forming apparatus, the comprehensive determination is made for the sheet feed tray resetting value, the sheet size resetting value, the sheet type resetting value specified by the user with selection of a sheet feed tray, a sheet size and a sheet type, respectively, and correspondence between the feeding information of each sheet feed tray and the user-specified feeding information. This leads to reduction in occurrence of cancelation of jobs, or lengthening of outputting time, and improves efficiency.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit capable of forming an image on a sheet of recording medium;

a sheet feed tray selecting unit that selects a tray from among a plurality of sheet feed trays to feed a sheet of recording medium to the image forming unit;

a medium size selecting unit that selects a first medium size of the sheet of recording medium from among a plurality of medium sizes; and a medium type selecting unit that selects a medium type of the sheet of recording medium from among a plurality of medium types, wherein the sheet feed tray selecting unit, the medium size selecting unit, and the medium type selecting unit include a function for specifying resetting values for an operation of the image forming unit;

a determining unit that determines the operation of the image forming unit based on a search result of a first sheet feed tray corresponding to the first medium size selected by the medium size selecting unit, a search result of a second sheet feed tray corresponding to the medium type selected by the medium type selecting unit, the selected tray selected by the sheet feed tray selecting unit, and the resetting value.

2. The image forming apparatus according to claim 1, wherein the determining unit determines the operation of the image forming unit by prioritizing the selected tray selected by the sheet feed tray selecting unit and the resetting value specified with selection of the selected tray.

3. The image forming apparatus according to claim 1, wherein the determining unit selects the operation of the image forming unit by prioritizing the first sheet feed tray over the second sheet feed tray irrespective of the resetting value when there are the first sheet feed tray corresponding to the first medium size selected by the medium size selecting unit and the second sheet feed tray corresponding to the medium type selected by the medium type selecting unit together.

4. The image forming apparatus according to claim 1, wherein the determining unit selects, for the operation of the image forming unit based on the resetting value, a second medium size that is a first scale factor closest to a full scale of the first medium size and the first scale factor when there is not the first sheet feed tray corresponding to the first medium size selected by the medium size selecting unit.

5. The image forming apparatus according to claim 4, the apparatus further comprising a selection information displaying unit that displays on a screen the tray selected by the sheet feed tray selecting unit, the first medium size selected by the medium size selecting unit, and the medium type selected by the medium type selecting unit, wherein the resetting value specifies one of the operations of forcible image formation by the image forming unit, image formation by the image forming unit, information display by the selection information displaying unit, and cancellation of image formation by the image forming unit.

6. The image forming apparatus according to claim 1, wherein the determining unit selects, for the operation of the image forming unit based on the resetting value, a third medium size that is a minimum size including the whole contents of the first medium size and a second scale factor for the third medium size when there is not the first sheet feed tray corresponding to the first medium size selected by the medium size selecting unit.

7. The image forming apparatus according to claim 6, the apparatus further comprising a selection information displaying unit that displays on a screen the tray selected by the sheet feed tray selecting unit, the first medium size selected by the medium size selecting unit, and the medium type selected by the medium type selecting unit, wherein the resetting value specifies one of the operations of forcible image formation by the image forming unit, image formation by the image forming unit, information display by the selection information displaying unit, and cancellation of image formation by the image forming unit.

8. The image forming apparatus according to claim 1, wherein the determining unit selects, for the operation of the image forming unit based on the resetting value, the second medium size that is a first scale closest to a full scale of the first medium size and the full scale when there is not the first sheet feed tray corresponding to the first medium size selected by the medium size selecting unit.

9. The image forming apparatus according to claim 8, the apparatus further comprising a selection information displaying unit that displays on a screen the tray selected by the sheet feed tray selecting unit, the first medium size selected by the medium size selecting unit, and the medium type selected by the medium type selecting unit, wherein the resetting value specifies one of the operations of forcible image formation by the image forming unit, image formation by the image forming unit, information display by the selection information displaying unit, and cancellation of image formation by the image forming unit.

10. The image forming apparatus according to claim 1, wherein the determining unit selects for the operation of the image forming unit based on the resetting value, a third medium size that is a minimum size including the whole contents of the first medium size and a full scale when there is not the first sheet feed tray corresponding to the first medium size selected by the medium size selecting unit.

11. The image forming apparatus according to claim 10, the apparatus further comprising a selection information displaying unit that displays on a screen the tray selected by the sheet feed tray selecting unit, the first medium size selected by the medium size selecting unit, and the medium type selected by the medium type selecting unit, wherein the resetting value specifies one of the operations of forcible image formation by the image forming unit, image formation by the image forming unit, information display by the selection information displaying unit, and cancellation of image formation by the image forming unit.

12. The image forming apparatus according to claim 1, wherein a priority table for feeding tray in which a prioritized tray among the plurality of sheet feed trays to convey the sheet of medium to the image forming unit is determined from a user- designation and a time to convey the sheet of medium from the plurality of sheet feed trays to the image forming unit is enabled to be stored.

13. An image forming method to be realized on an image forming apparatus, the image forming apparatus including an image forming unit capable of forming an image on a sheet of recording medium; a sheet feed tray selecting unit that selects a tray from among a plurality of sheet feed trays to feed a sheet of recording medium to the image forming unit; a medium size selecting unit that selects a first medium size of the sheet of recording medium from among a plurality of medium sizes; and a medium type selecting unit that selects a medium type of the sheet of recording medium from among a plurality of medium types, wherein the sheet feed tray selecting unit, the medium size selecting unit, and the medium type selecting unit include a function for specifying resetting values for an operation of the image forming unit, the image forming method comprising:

determining the operation of the image forming unit based on a search result of a first sheet feed tray corresponding to the first medium size selected by the medium size selecting unit, a search result of a second sheet feed tray corresponding to the medium type selected by the medium type selecting unit, the selected tray selected by the sheet feed tray selecting unit, and the resetting value.

14. A computer program product comprising a computer usable medium having computer readable program codes embodied in the medium that, when executed, causes a computer to execute an image forming method to be realized on an image forming apparatus, the image forming apparatus including an image forming unit capable of forming an image on a sheet of recording medium; a sheet feed tray selecting unit that selects a tray from among a plurality of sheet feed trays to feed a sheet of recording medium to the image forming unit; a medium size selecting unit that selects a first medium size of the sheet of recording medium from among a plurality of medium sizes; and a medium type selecting unit that selects a medium type of the sheet of recording medium from among a plurality of medium types, wherein the sheet feed tray selecting unit, the medium size selecting unit, and the medium type selecting unit include a function for specifying resetting values for an operation of the image forming unit, the computer readable program codes causing the computer to execute:

determining the operation of the image forming unit based on a search result of a first sheet feed tray corresponding to the first medium size selected by the medium size selecting unit, a search result of a second sheet feed tray corresponding to the medium type selected by the medium type selecting unit, the selected tray selected by the sheet feed tray selecting unit, and the resetting value.

* * * * *